US006094962A

United States Patent [19]

Eisentraut et al.

[11] Patent Number: 6,094,962

[45] Date of Patent: Aug. 1, 2000

[54] METHOD FOR PROFILE-KNEADING WORKPLACES

[75] Inventors: Holger Eisentraut, Langenselbold; Heinrich Wolf, Hailer, both of Germany

[73] Assignee: W.C. Heraeus GmbH & Co. KG, Hanau, Germany

[21] Appl. No.: 09/263,180

[22] Filed: Mar. 5, 1999

[30] Foreign Application Priority Data

Mar. 6, 1998 [DE] Germany ..... 198 09 674

[51] Int. Cl.[7] ..... B21J 7/16

[52] U.S. Cl. ..... 72/403; 72/408

[58] Field of Search ..... 72/403, 402, 408, 72/76

[56] References Cited

U.S. PATENT DOCUMENTS

| | | | |
|---|---|---|---|
| 2,790,188 | 4/1957 | Fray | 72/403 |
| 5,162,038 | 11/1992 | Wilker | 600/22 |

FOREIGN PATENT DOCUMENTS

| | | | |
|---|---|---|---|
| 477951 | 6/1929 | Germany | 72/403 |
| 916487 | 8/1954 | Germany | 72/403 |
| 1527471 | 8/1969 | Germany | 74/402 |
| 11929 | 5/1914 | United Kingdom | 72/403 |
| 681986 | 11/1952 | United Kingdom | 72/403 |
| 682031 | 11/1952 | United Kingdom | 72/403 |
| 844219 | 8/1960 | United Kingdom | 72/403 |
| 8804163 | 5/1988 | WIPO . | |
| 9401982 | 2/1994 | WIPO . | |

*Primary Examiner*—Daniel C. Crane
*Attorney, Agent, or Firm*—Fulbright & Jaworski,LLP

[57] ABSTRACT

For the profile kneading of workpiece in strand from (semiproducts) which are transported along a central axis into a working station (profile kneading machine) at least two dies situated opposite one another in pairs for working on the surface of the workpiece are driven by rams at their extremity remote from the axis; the rams are driven radially toward the axis by rolls (cylinders, balls) moving on a circular path relative to outer guiding surfaces of the rams; at the same time at least two pairs of dies, whose radial driving directions are displaced from one another by a given angle (90°), are driven successively by the rolls in a radial direction by means of the guiding surfaces of the rams; the edge length of the dies in each working step is greater than the targeted edge length of the workpiece (semiproduct) that is to be worked.

1 Claim, 2 Drawing Sheets

METHOD FOR PROFILE-KNEADING WORKPLACES

BACKGROUND OF THE INVENTION

1. Field of the Invention

The Invention relates to a method for the profile kneading of a workpiece in strand form.

2. Description of the Prior Art

In the "Zeitschrift for Maschinen, Konstruktion und Fertigung," Carl Hanser Veriag, Munich, No. 125, 1992, on page 273, there appears a disclosure entitled, "Rohrund Stabquerschnitte wirtschaftlich durch Rundknetenumformen" [tube and bar cross sections economically by circular kneading] by Dr. Ing. Bernhard Moller of Pforzhelm. In this disclosure there is explained the circular kneading of workpiece which are transported along a central axis in the circular kneading machine with a feeder, two pairs with confronting dies serving to work the surface of the workpiece; the dies are arranged on inserts or spacers on their side facing away from the workplace to form rams which in turn are driven simultaneously by wheels or rolls or balls radially toward the axis on a circular path relative to the outer guiding surfaces of the rams; both pairs of dies, whose thrust directions are shifted 90° from one another, are simultaneously struck by the rams radially toward the axis, so that the working of the surface is performed by kneading (hammering) the workpiece. Thus all metallic materials can be worked if they have sufficient elasticity; as a rule, the elasticity should be at least 5 to 15% depending on their shaping. On account of the characteristics of the circular kneading process it is possible in practice only to shape axially symmetrical workpiece, Including for example hollow cylindrical shapes, while the production of strand-like profiles is virtually impossible.

BRIEF SUMMARY OF THE INVENTION

Setting out from the circular kneading process described above, the invention is addressed to the problem of shaping workpiece into profiles which can also depart from axial symmetry, such as strand-like workpiece (semiproducts) of rectangular cross section; at the same time any possible formation of fins and cracks at the outer edges of the shaped workpiece must be prevented.

It proves to be an advantage that it is possible to produce shapes economically from a blank supplied in strand form with a rectangular or square or round cross section with a high degree of transformation, so that cutting methods, which usually involve loss of material, can be avoided.

In a profile kneading machine for the practice of the method it proves to be especially advantageous that the shape of the profile cross section can be adapted to the desired dimensions in a relatively simple manner, and it proves to be especially advantageous that a fine adjustment of the shape can be made with spacers (wedge-shaped) between the ram and the dies.

BRIEF DESCRIPTION OF THE DRAWINGS

The subject matter of the invention is further explained below with the aid of the drawings, in which.

DETAILED DESCRIPTION OF THE INVENTION

Figure 1A:
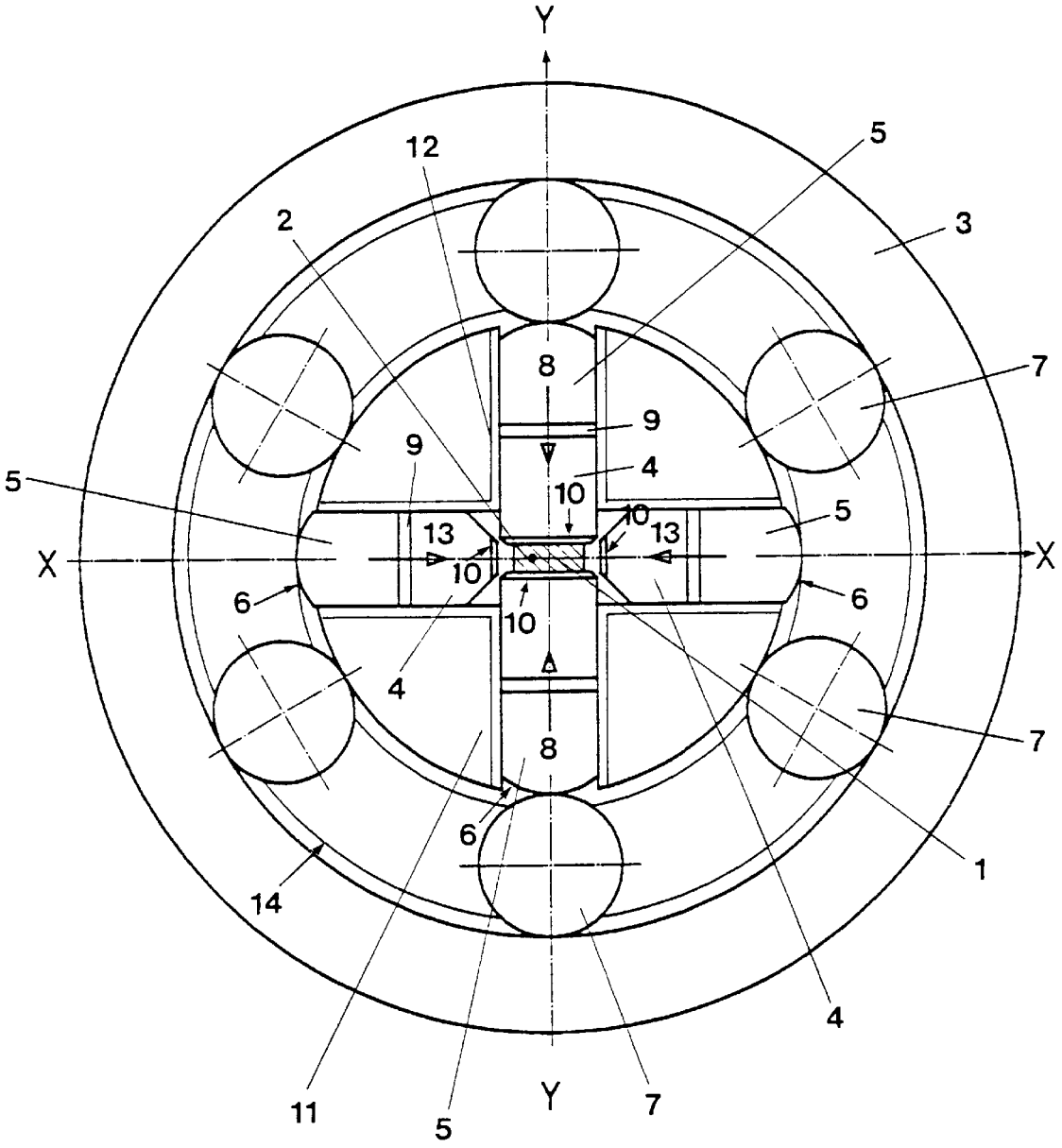
FIG. 1*a* shows a cross-sectional representation of the invention.

In FIG. 1*a* the workpiece 2 is inserted along a central axis 1 into the profile kneading machine, although the feeding and mounting system for such a strand-shape workpiece (semiproduct) 2 is not shown. The dies 4 and rams 5 plus any spacers 9 between them which work on the workpiece are disposed for displacement radially toward the central axis 1 in a sliding guide 11 which has hollow profiles 12 disposed in cross or star shape for the guidance of dies 4 and rams 5; dies 4 and rams 5 are biased outwardly by spring forces so that the surface of the workpiece in the state of rest is free to move. The sliding guide 11 is stationary and surrounded by a roller cage 14 and supporting ring 3 disposed circularly about the central axis 1 and bearing rolls 7 or cylinders or balls disposed for rotation parallel to the central axis 1 and protruding from the hollow cylindrical interior of the roller cage 14 toward the sliding guide 11.

The rams 5 have at their outwardly facing surface guiding surfaces 6 which are forced by the revolving rolls 7 against a spring bias toward the central axis, so that both the rams 5 and dies 4 are pressed or forced with pulsations toward the central axis as the particular roll 7 passes over them.

As it can be seen with the aid of FIG. 11, the dies 4 lying along the axis identified by the symbol Y and situated diametrically opposite one another are in positive engagement at their guiding surfaces 6 with the rolls 7, so that, starting from the guiding surface 6, ram 5 and die 4, they are driven diametrically against one another along the direction 8, and are able to work the surface of workpiece 2 (semiproduct) with a pulsed hammering or pressing action.

After the roller cage 14 has rotated 60° no pressing action whatever is applied to the pair of dies 4 in direction Y, while roll 7 now presses the rams 5 and dies 4 oppositely to one another in direction 13 along the X axis, so that now the dies can work the surfaces along the X axis.

Figure 1B:
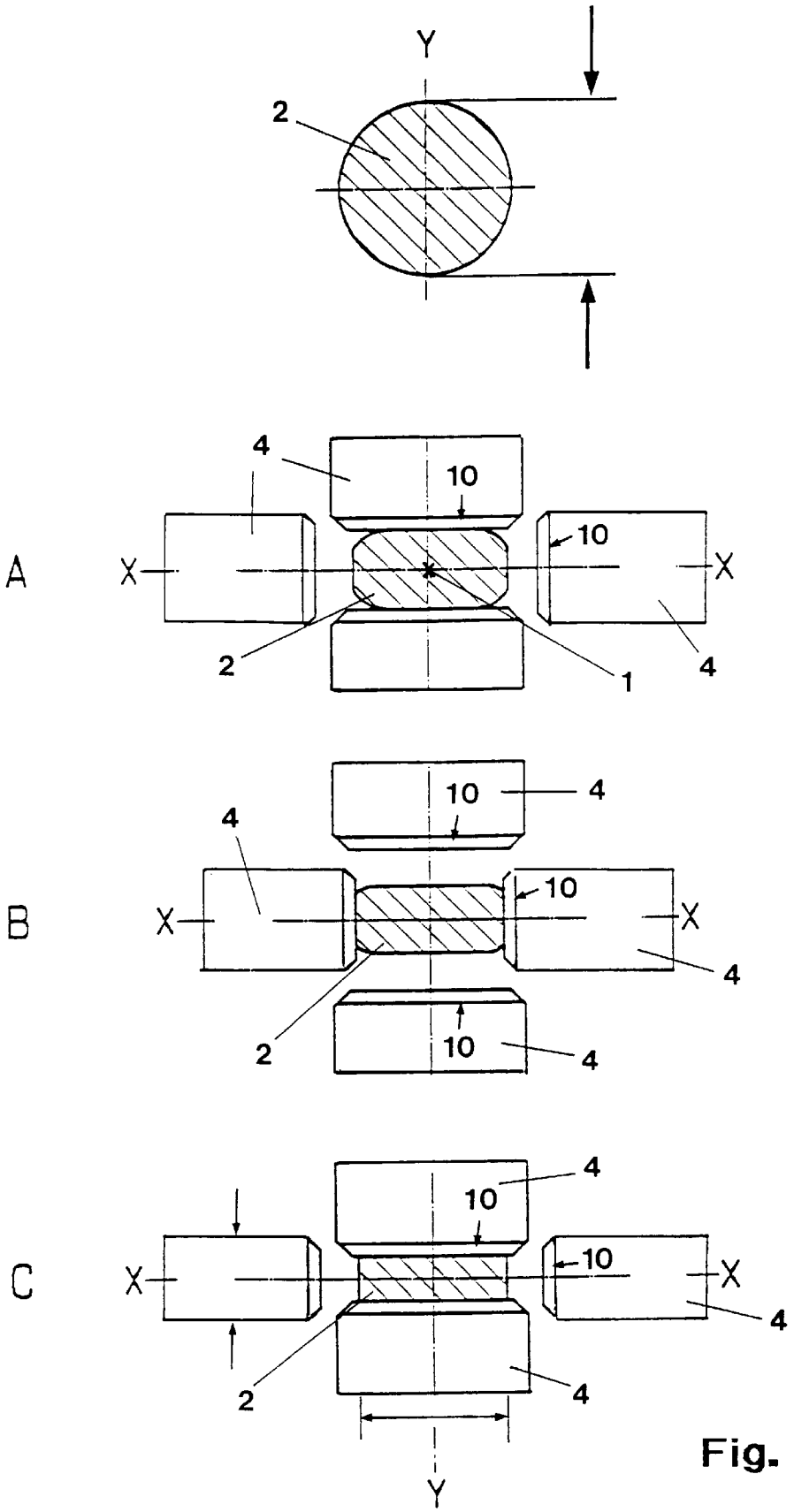
FIG. 1*b* shows a cross-sectional representation of work steps A, B and C for operating on the workpiece.

Since only two die-and-ram pairs can be forced together by two opposite rolls, any cracking or formation of fins along the arises of the workpiece (semiproduct) being formed can be prevented in a reliable manner. Thus, according to FIG. 1*b*, pressing or hammering strokes take place successively in operations A, B, C . . . in direction Y and then in direction X, and again in direction Y and then in direction X, so that the surfaces are always worked by kneading or hammering; at the same time the edge length 10 of the die 4 is longer in each action than the targeted edge length of the workplace or semiproduct.

In another preferred embodiment, it Is possible to provide, instead of the spacers 9, wedge-shaped spacers which have wedge faces which can be driven along the central axis so that a continuous formation of the profile is possible.

What is claimed is:

1. Method for the profile kneading of a workpiece in a work station, wherein at least two dies opposite one another, in pairs for working the surface of the workpiece having an axis, are driven by rams at their end remote from the axis, said rams being driven in a radial direction toward the axis by rolls moving on a circular path relative to outer guiding surfaces of the rams, at least two pairs of die hammers having radial striking directions, wherein said radial striking directions of which are shifted one against the other by a given angle on the axis, impinging upon the workpiece simultaneously in opposite directions, driving the guiding surfaces of the rams by the rolls in a radial direction pairwise successively in time so that two die ram pairs of at least two rolls diametrically opposite one another in pairs are driven through the ram guiding surfaces in a radial direction, the radial direction of both pairs crossing at no more than a right angle, providing the at least two roll pairs so as to act successively in time on the outer guide surfaces in a form-fitting manner, providing said workpiece with a surface in the form of a strand and which differs in axial symmetry and transporting said workpiece along a central axis into the radially movable dies so that the workpiece is impinged simultaneously on opposite sides thereof, and providing the workpiece contacting edge lengths of the dies with a greater length than the targeted edge length per working step of the workpiece being processed.

* * * * *

UNITED STATES PATENT AND TRADEMARK OFFICE

CERTIFICATE OF CORRECTION

PATENT NO. : 6,094,962
DATED : August 1, 2000
INVENTOR(S) : Eisentraut et al.

It is certified that error appears in the above-identified patent and that said Letters Patent is hereby corrected as shown below:

In the cover page, in the Title, change "WORKPLACES" to - - WORKPIECES - -.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*